US005225849A

United States Patent [19]

Suzuki et al.

[11] Patent Number: 5,225,849

[45] Date of Patent: Jul. 6, 1993

[54] IMAGE RECORDING APPARATUS AND METHOD FOR PERFORMING RECORDING BY MAKING INK ADHERE TO A RECORDING MEDIUM AND INCORPORATING IMAGE DATA CORRECTION

[75] Inventors: Akio Suzuki, Yokohama; Yoshihiro Takada, Kawasaki; Masami Izumizaki, Tokyo; Hisashi Fukushima, Yokohama; Toshimitsu Danzuka, Tokyo, all of Japan

[73] Assignee: Canon Kabushiki Kaisha, Tokyo, Japan

[21] Appl. No.: 679,147

[22] Filed: Mar. 28, 1991

Related U.S. Application Data

[63] Continuation of Ser. No. 365,778, Jun. 14, 1989, abandoned.

[30] Foreign Application Priority Data

Jun. 17, 1988 [JP] Japan ..... 63-148229
Jul. 14, 1988 [JP] Japan ..... 63-175341

[51] Int. Cl.[5] ..... B41J 2/05

[52] U.S. Cl. ..... 346/1.1; 346/140 R; 358/296

[58] Field of Search ..... 346/140, 75, 1.1; 358/75, 80

[56] References Cited

U.S. PATENT DOCUMENTS

| | | | |
|---|---|---|---|
| 4,178,597 | 12/1979 | Isayama | 346/75 |
| 4,272,771 | 6/1981 | Furukawa | 346/75 |
| 4,516,135 | 5/1985 | Todoh | 346/76 PH |
| 4,528,576 | 7/1985 | Koumura et al. . | |
| 4,538,173 | 8/1985 | Kirjauainen | 358/296 X |
| 4,547,784 | 10/1985 | Erlichman et al. | 346/76 PH |
| 4,586,054 | 4/1986 | Kurita | 346/76 PH |
| 4,595,948 | 6/1986 | Itoh et al. . | |
| 4,635,078 | 1/1987 | Sakurada | 346/140 |
| 4,682,186 | 7/1987 | Sasaki | 346/140 |
| 4,714,964 | 12/1987 | Sasaki . | |
| 4,827,279 | 5/1989 | Lubinsky | 346/76 PH X |
| 4,908,635 | 3/1990 | Iwasawa | 346/140 |
| 5,038,208 | 8/1991 | Ichikawa | 358/75 |

FOREIGN PATENT DOCUMENTS

| | | |
|---|---|---|
| 123034 | 9/1979 | Japan . |
| 62-92851 | 4/1987 | Japan . |

*Primary Examiner*—Joseph W. Hartary
*Attorney, Agent, or Firm*—Fitzpatrick, Cella, Harper & Scinto

[57] ABSTRACT

An image recording apparatus and method performs recording by making an ink adhere to a recording medium according to the blot ratio of a recording medium, when using an ink droplet or heat sensitive ink. Input recording data is discriminated based on a predetermined reference value based on the blot ratio and when the image data is larger than the reference value, the image data is reduced in order to reduce the ink dot size. Reducing the ink dot size at a recording boundary improves the quality of the image recorded at the recording boundary.

39 Claims, 9 Drawing Sheets

IMAGE RECORDING APPARATUS AND METHOD FOR PERFORMING RECORDING BY MAKING INK ADHERE TO A RECORDING MEDIUM AND INCORPORATING IMAGE DATA CORRECTION

This application is a continuation of application Ser. No. 07/365,778 filed Jun. 14, 1989, now abandoned.

BACKGROUND OF THE INVENTION

Field of the Invention

The present invention relates to an image recording apparatus.

Related Background Art

An ink-jet recording apparatus is known as a conventional image recording apparatus to inject an ink on a recording medium to perform image recording.

An ink-jet recording apparatus is a non-impact recording apparatus which has advantages of low noise, and easy color image recording using multi-color inks. Therefore, ink-jet recording apparatuses have been very popular in a variety of fields.

FIG. 1 is a schematic perspective view of a conventional ink-jet recording apparatus.

Referring to FIG. 1, a recording medium 5 as a roll is clamped between feed rollers 3 through convey rollers 1 and 2 and is fed upon driving of a subscanning motor 15 coupled to the feed rollers 3 in a direction indicated by an arrow f. Parallel guide rails 6 and 7 extend in a direction perpendicular to the recording medium 5. A recording head unit 9 mounted on a carriage 8 is scanned in the right-and-left direction. Yellow, magenta, cyan, and black heads 9Y, 9M, 9C, and 9Bk are mounted on the carriage 8, and four ink tanks are connected thereto, respectively. The recording medium 5 is intermittently fed by a printing width of the recording head unit 9. The recording head unit 9 is scanned in a direction indicated by arrow P to inject ink droplets corresponding to an image signal while the recording medium 5 is kept stopped.

In the ink-jet recording apparatus described above, properties of the recording medium are very important. In particular, a blot characteristic of an ink on the recording medium greatly influences image quality.

An index representing the ink blot characteristic of the recording medium is a "blot ratio". The blot ratio is a ratio of the diameter of the ink dot on the recording medium to the diameter of the ink droplet injected from an ink-jet nozzle, that is Blot Ratio=(Dot Diameter on Recording Medium)/(Droplet Diameter of Injected Ink)

For example, if a droplet diameter of the injected ink is 30 μm and a dot having a diameter of 90 μm is formed on a recording medium, the blot ratio of this recording medium is 3.0.

A recording medium having a large blot ratio tends to have a higher image density, while a recording medium having a small blot ratio tends to have a lower image density. In order to minimize image variations, variations in blot ratio of a recording medium must be sufficiently minimized.

Properties of the recording medium and especially the blot ratio vary depending on slight changes in environmental conditions during fabrication of the recording medium and the medium materials. It is therefore difficult to manufacture a recording medium having a constant blot ratio.

When the blot ratio varies, the following problems are posed in a serial scan type ink-jet recording apparatus, as shown in FIG. 1, in addition to variations in image densities.

In the serial scan ink-jet recording apparatus shown in FIG. 1, the multi-nozzle head unit 9 having a plurality of parallel nozzles is scanned in a direction indicated by arrow A to sequentially perform image recording by each width d in an order of (1), (2), and (3), as shown in FIGS. 2A and 2B. The width d is determined by the number of nozzles of the head unit and a recording density. For example, when the number of nozzles is 256 and a recording density is 400 dots/inch (dpi), the width d is given as 16.256 ($=256\times2.54/400$) mm.

When an amount of ink to be used for recording is small as in single-color recording, the ink can be sufficiently absorbed in the recording medium, and the width of the recorded image is almost equal to the recording width d. For this reason, when recording is performed in the direction of arrow A after the recording head unit is scanned by the width d in the direction of arrow B, a boundary between the adjacent scanning lines is not noticeable in an image, as shown in FIG. 2A.

However, when image recording of a high-density portion is performed, some recording media cannot sufficiently absorb an ink, and the ink blots in the lateral direction. The resultant image width becomes $d=\Delta d$. In this case, if the scanning width of the recording head unit in the B direction is given as d, the adjacent lines overlap by a width $\Delta d$, as shown in FIG. 2B, thereby forming black stripes. However, when the scanning width in the B direction is given as $d=\Delta d$ white stripes appear in a low-density portion.

The amount $\Delta d$ of the image width in the high-density portion varies depending on the properties of the recording medium. In particular, when the blot ratio is large, the amount $\Delta d$ is increased. To the contrary, when the blot ratio is small, the amount $\Delta d$ is small accordingly. These facts were confirmed by experiments. In order to prevent formation of black and white stripes, the blot ratio must be minimum. When the blot ratio, however, is excessively small, the image density is undesirably lowered. Therefore, it is very preferable to define lower and upper limits of the blot ratio and to use a recording medium having a blot ratio falling within the range of the upper and lower limits.

It is, however, difficult to manufacture recording media while managing their properties to fall within a predetermined range. For this reason, a recording medium having a large blot ratio must be inevitably used. In this case, black stripes tend to occur in a high-density portion. This problem also occurs in a heat-sensitive recording apparatus.

SUMMARY OF THE INVENTION

It is an object of the present invention to solve the above problems and to provide an image recording apparatus which can prevent degradation of recording image quality of recording media having different ink absorption properties represented by a blot ratio.

According to an aspect of the present invention, there is provided an image recording apparatus for performing image recording by using a recording head unit having a plurality of recording elements, comprising a means for converting a value of image data recorded by a predetermined recording element which is included in the recording elements and is located at a predetermined position, the value being converted on the basis of a value of image data associated with recording.

According to the above aspect of the present invention, image data of a head end portion is minimized for a high-density area in, e.g., a serial scan ink-jet apparatus, and the black stripes tend not to be formed in a high-density portion.

According to another aspect of the present invention, there is provided an image recording apparatus including a plurality of recording heads each having a plurality of parallel recording elements arranged in a predetermined direction to scan the recording heads in a direction different from the predetermined direction, thereby performing image recording, comprising a means for correcting a value of an image signal recorded by the recording elements in accordance with a total sum of image signals recorded by recording elements located at ends of the recording head.

According to the above aspect, since the image signal applied to the end recording element of the head is corrected in accordance with the total sum of the image signals recorded by the end recording elements of the head (i.e., the sum of image signals recorded by the end recording elements of each of the plurality of recording heads arranged to correspond to a plurality of colors), an image free from black stripes in a high-density portion can be obtained.

DESCRIPTION OF THE PREFERRED EMBODIMENTS

The present invention will be described with reference to the accompanying drawings.

First Embodiment

Figure 3:
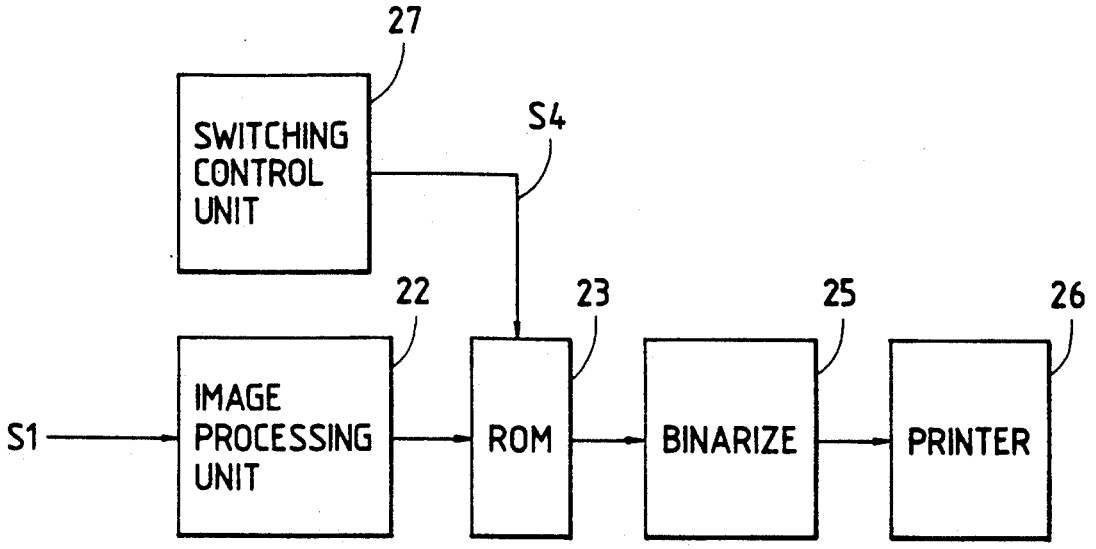
FIG. 3 is a block diagram showing a first embodiment of the present invention.
Figure 7:
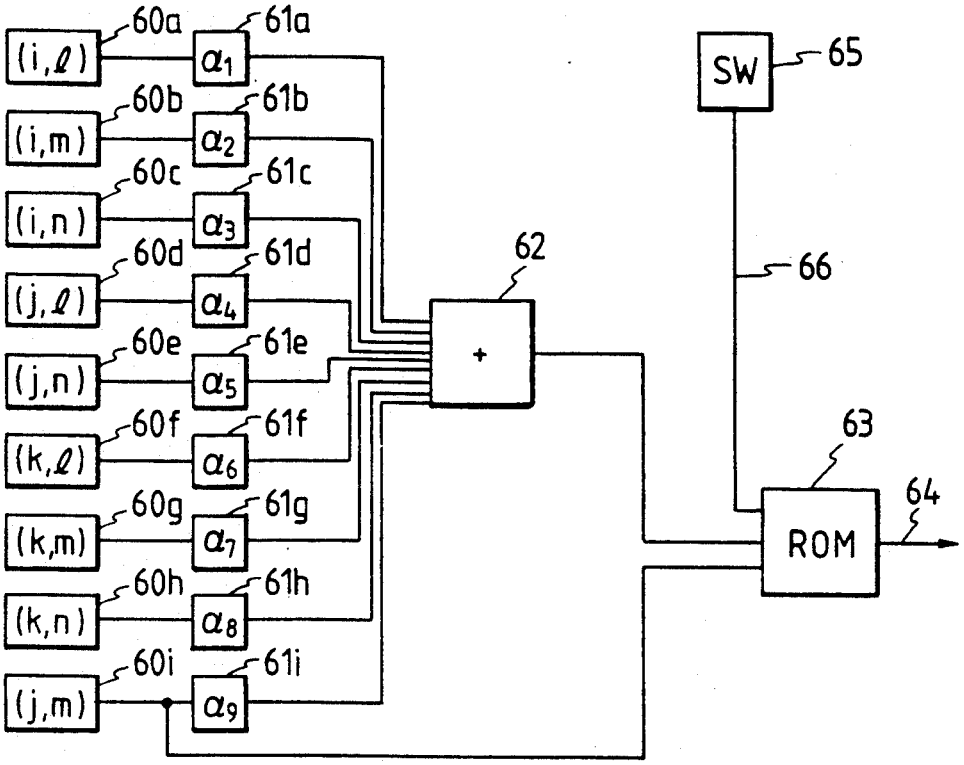
FIGS. 7 and 8 are block diagrams showing third and fourth embodiments of the present invention, respectively.

FIG. 3 shows a first embodiment of the present invention. The first embodiment comprises an image processing unit 22, a ROM 23, a binarizing circuit 25, a serial scan ink-jet recording apparatus 26 as shown in FIG. 7, and a switching control unit 27 for switching conversion tables in the ROM 23. An input image signal S1 is input to the image processing unit 22, and a control signal S4 is supplied from the switching control unit 27 to the ROM 23.

The input image signal S1 output from an image reader or external equipment is subjected to color correction, gamma conversion, and the like in the image processing unit 22. The processed signal is then input to the ROM 23 and converted into a value in accordance with a table stored in the ROM 23.

Figure 4A:
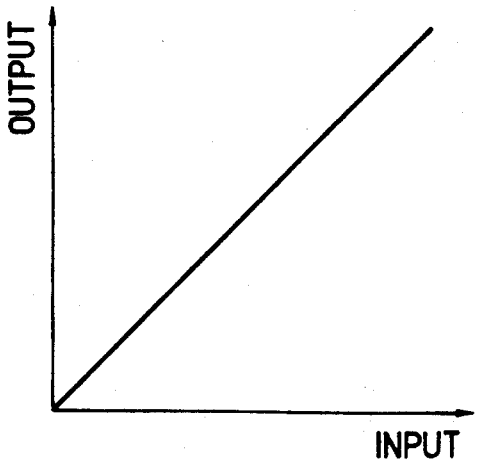
FIGS. 4A and graphs for explaining image data conversion of the first embodiment of the present invention.
Figure 4B:
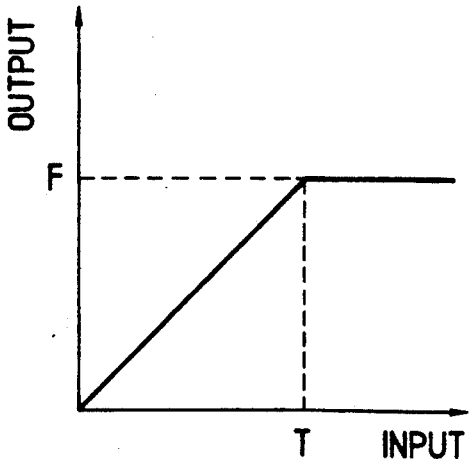

The ROM 23 has conversion tables respectively corresponding to FIGS. 4A and 4B. These tables are selectively used in response to the control signal S4. The switching control unit 27 is constituted by a microcomputer (may be constituted by a main control unit of the apparatus) or appropriate logic circuits. In this embodiment, an image density determined by nozzles associated with recording of a boundary of the adjacent scanning lines, i.e., nozzles near the upper end of the recording head unit 9, is monitored. The signal S4 is then switched to be logic "1" or "0" on the basis of the monitoring result.

When the control signal S4 is set at logic "0", conversion shown in FIG. 4A is performed by the ROM 23. However, when the signal S4 is set at logic "1", conversion shown in FIG. 4B is performed.

The control signal S4 is normally set at logic "0" but is set at logic "1" only when an image signal is supplied to an end nozzle of the head unit 9. In the normal state, no conversion is performed, as shown in FIG. 4A. When an image signal supplied to the end nozzle exceeds an input level T, the image signal is clipped to an output level F.

An output from the ROM 23 is binarized by the binarizing circuit 25 in accordance with a dither method or the like. The binarized output from the binarizing circuit 25 is input to the recording apparatus 26. An image is then recorded by the recording apparatus 26.

With the above arrangement, the number of dots at an end portion is reduced only when a density of an image recorded by the end nozzle is high, thereby recording a high-density portion without forming black stripes.

Second Embodiment

An operation for determining whether a high-density portion is present is performed for only an image signal supplied to an end nozzle in the first embodiment. However, when only the image signal applied to an end nozzle represents a high density, dots of the end nozzles are selectively reduced although an increase in image width by blot is small, so that inconvenience occurs.

A second embodiment is made to eliminate this inconvenience.

Figure 5:
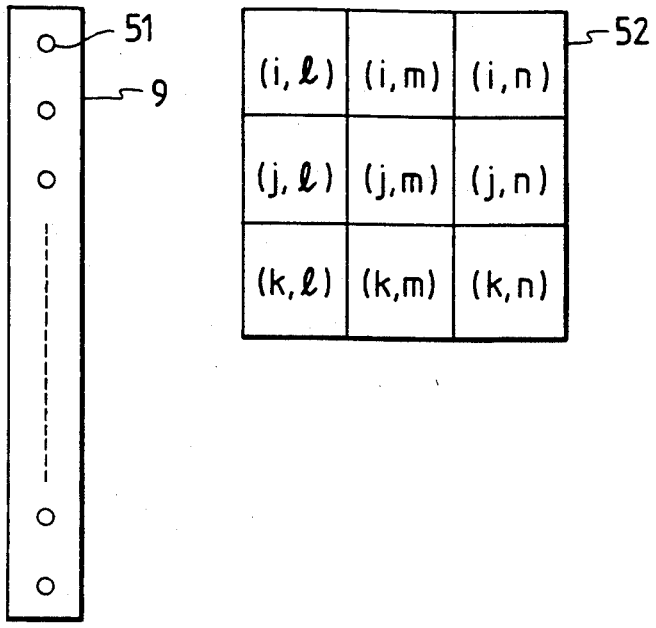
FIG. 5 is a view for explaining a second embodiment of the present invention.

FIG. 5 is a view for explaining the second embodiment.

Figure 1:
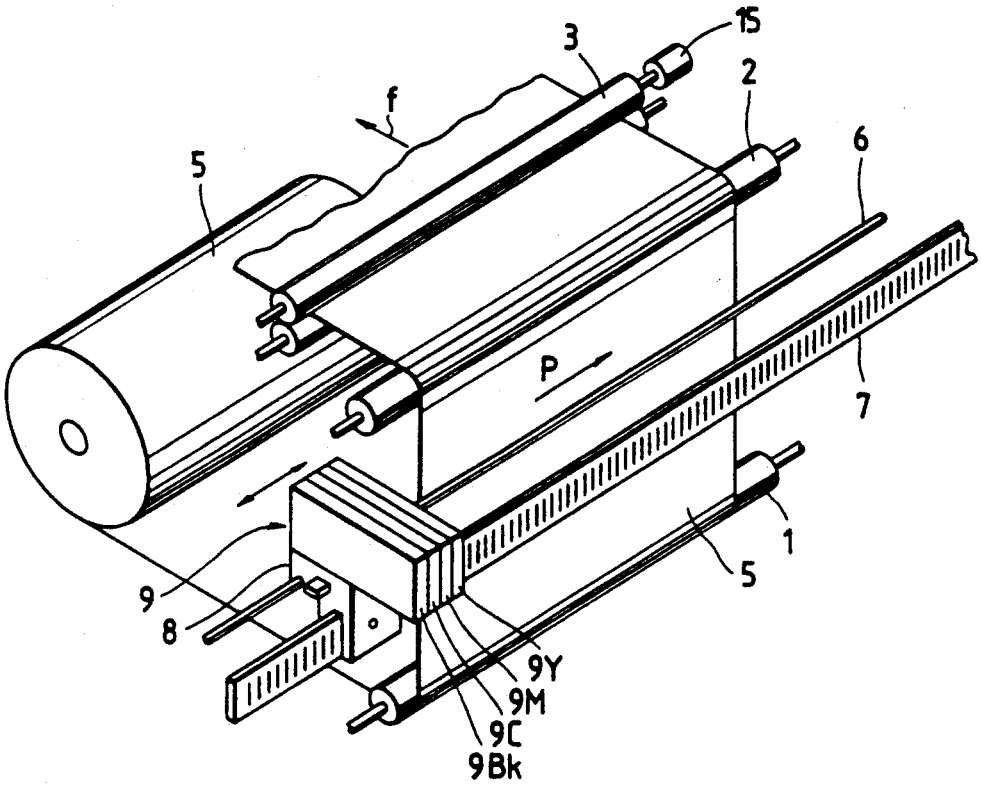
FIG. 1 PRIOR ART
FIG. 1 is a perspective view showing an arrangement of an ink-jet recording apparatus as a recording apparatus which can employ the present invention.
Figure 2A:
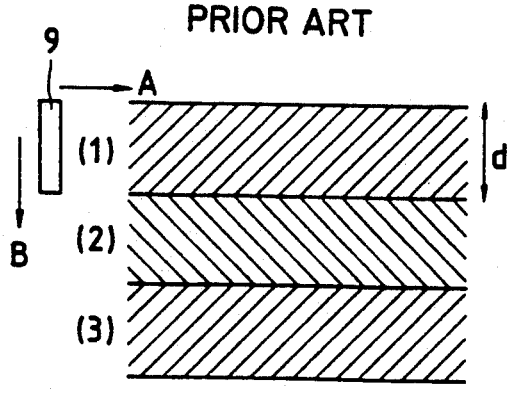
FIG. 2A PRIOR ART
FIGS. 2A and 2B are views for explaining a mechanism for forming black stripes.
Figure 2B:
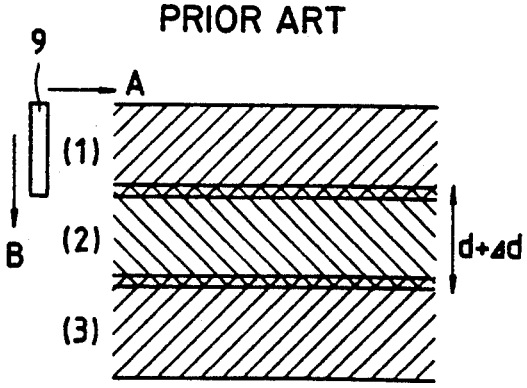
FIG. 2B PRIOR ART

The recording head unit 9 shown in FIG. 1 includes nozzles 51. Image data are arranged in a matrix 52. The image data of the ith row is supplied to the end nozzle in the previous scanning cycle, the image data of the jth row is supplied to the end nozzle in the present scanning cycle, and image data of the kth row is applied to the second nozzle spaced apart from the end portion. Pixels of the mth column are pixels of interest subjected to present recording, pixels of the lth column are pixels associated with the previous recording cycle, and pixels of the nth column are pixels associated with the next recording cycle.

The second embodiment employs a $3\times3$ pixel matrix having as its center a pixel (j,m) recorded by the end nozzle, and the dots recorded by the end nozzles are extracted by a sum of image data of the pixels within the matrix. More specifically, the image data are weighted in accordance with the positions of the pixels within the matrix. A sum of the image data obtained by multiplying pixel data with the corresponding weighting coefficients is calculated. If the sum is large, the value of the image data supplied to the end nozzle is reduced.

Figure 6:
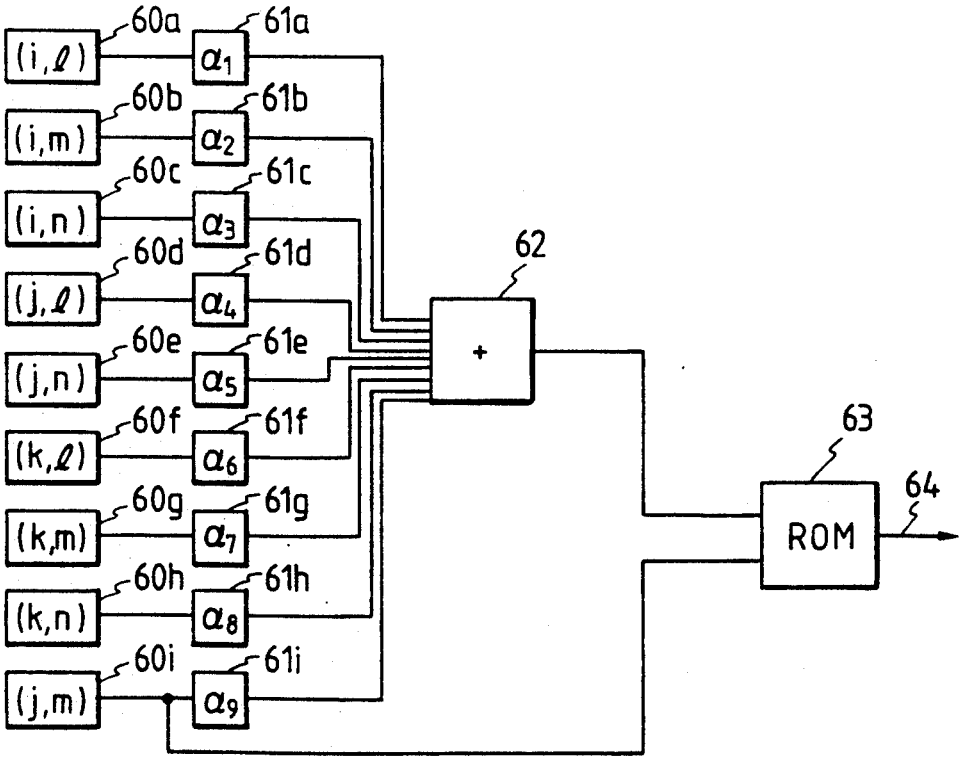
FIG. 6 is a block diagram showing the second embodiment of the present invention.

FIG. 6 shows an arrangement of a control unit for performing such processing.

The control unit includes buffers 60*a* to 60*i* for temporarily storing image data, and more particularly image data corresponding to the pixels shown in FIG. 5, multipliers 61*a* to 61*i* for multiplying the image data with coefficients $\alpha 1$ to $\alpha 9$, respectively, an adder 62 for adding outputs from the multipliers 61*a* to 61*i*, and a ROM 63 for outputting corrected image datas 64 of the pixel (j,m) in accordance with the output from the adder and the image data of the pixel (j,m) recorded by the end nozzle. Corrected data D is given as follows:

$$D=I(1-\beta\cdot S)$$

where S is an output from the adder, I is image data of the pixel (j,m) before correction, and $\beta$ is a constant.

When a total sum of the image data within the matrix is increased, the corrected data is reduced. Corrected images data S64 is then binarized by the binarizing circuit 25, as shown in FIG. 3. The binarized signal is supplied to the ink-jet recording apparatus 26.

As a result, when the total sum of the image data within the matrix is large, i.e., when the amount of ink recorded by nozzles near the end of the head is large, dots formed by the end nozzles are extracted, and image recording free from black stripes can be performed.

Third Embodiment

Dot extraction is changed when the properties of the recording media are changed depending on lots according to a third embodiment.

FIG. 7 is a block diagram showing the main part of this embodiment. The same reference numerals as in FIG. 6 denote the same parts in FIG. 7. The main part includes a switch (SW) 65 for outputting a two-bit signal S66. A ROM 63 receives an output from an adder 62, the pixel data of a pixel (j,m), and a signal S66 selected by the switch 65. Corrected image data D is the same as that of the second embodiment:

$$D=I(1-\beta\cdot S)$$

However, in the third embodiment, the value $\beta$ can be changed by a signal S66. When a blot ratio of a recording medium is large, the value $\beta$ is increased to increase the correction amount. However, when the blot ratio is small, the value $\beta$ is decreased to decrease the correction amount.

Even if the properties of the recording media are changed depending on their lots, optimal correction can always be performed to obtain an image free from black stripes.

Fourth Embodiment

Figure 8:
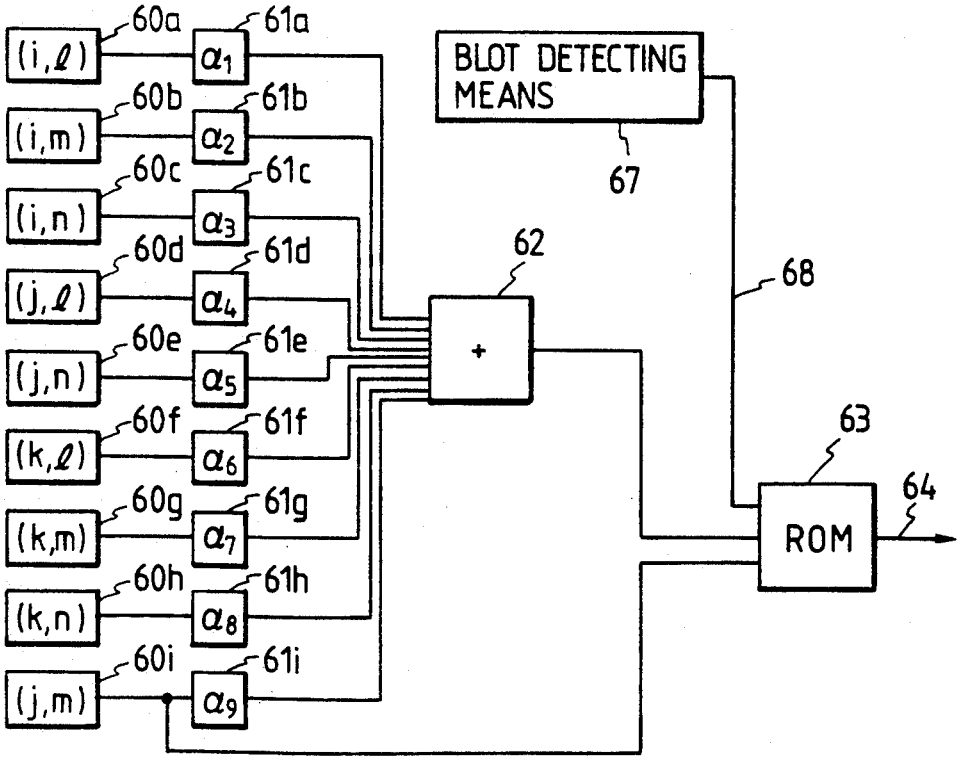

A fourth embodiment of the present invention exemplifies an arrangement for automatically determining blot properties of paper and to switch the correction amount on the basis of the determination result. FIG. 8 shows the main part of this embodiment. The same reference numerals as in FIGS. 6 and 7 denote the same parts in FIG. 8.

Referring to FIG. 8, the arrangement includes a blot detecting means 67. The blot detecting means 67 records a test pattern on, e.g., a recording medium, and causes a CCD sensor or the like to read a recording width of the test pattern or an image density to detect blot of the recording medium. The blot detecting means 67 outputs a two-bit signal S68 on the basis of a blot detection result.

A ROM 63 receives an output S from an adder 62 and image data I of a pixel (j,m) and outputs corrected image data S64. Corrected image data D is given as follows in the same manner as in the second and third embodiments:

$$D=I(1-\beta\cdot S)$$

The value $\beta$is switched in accordance with the signal S68. When the blot ratio is determined to be large on the basis of the blot detection result because the recording width is increased or an image density is high, the value $\beta$ is increased to set a larger correction amount. However, when the blot ratio is determined to be small, the value $\beta$ is decreased to set a smaller correction amount.

According to this embodiment, even if the recording medium is changed, excellent image recording free from black stripes can always be performed.

In the first to fourth embodiments described above, the binary recording printer is used as the ink-jet recording apparatus. However, the ink-jet recording apparatus may be an apparatus capable of modulating an ink injection amount by a multivalue or analog scheme.

In a multivalue printer, the binarizing circuit 25 in FIG. 3 is replaced with a unit for performing multivalue processing of three or more values. In an analog modulation printer, the binarizing circuit 25 is omitted, and image data is directly input to the recording apparatus 26, thereby performing ink injection according to the image data.

Each of the matrices of the second to fourth embodiments consists of $3\times3$ pixels. However, the present invention is not limited to this. A printing ink amount of the end portion may be determined in accordance with a sum of image data of a plurality of pixels.

Image data conversion is not limited to the one shown in FIG. 4 and exemplified by the second to fourth embodiments. The present invention is not limited to any specific image data conversion if the value of image data can be reduced in a high-density portion.

Furthermore, in the third and fourth embodiments, the signal for switching the value $\beta$ consists of two bits. However, the present invention is not limited to this signal. The number of bits of the signal is not limited to two.

In addition, in each of the first to fourth embodiments, dot extraction is performed for the nozzles at the upper end portion of the head unit 9. However, nozzles at the lower end portion and other nozzles may be similarly processed in place of the above operation or together therewith.

Moreover, according to the present invention, the ink-jet printer is used. However, the present invention is applicable to a printer which poses a blot problem, e.g., a thermal transfer printer using a sublimable dye.

In each embodiment described above, the present invention is applied to a serial scan recording apparatus for performing recording while scanning the recording medium with the recording head unit. However, the present invention is also applicable to a line printer type ink-jet recording apparatus having injection ports aligned along the entire width of the recording medium. When the present invention is applied to such an apparatus and image data is appropriately extracted, uniform images can be formed on recording media having different blot ratios and are free from "white stripes"or "black stripes".

When a recording amount is large, image data recorded by the end nozzle is appropriately extracted to perform excellent image recording free from black stripes even in a high-density portion. The extraction is or is not performed and the image data correction amount is switched in accordance with the types of recording medium. Therefore, a stable image having high quality and easily corresponding to changes in properties of the recording medium can be obtained.

Fifth Embodiment

Figure 9:
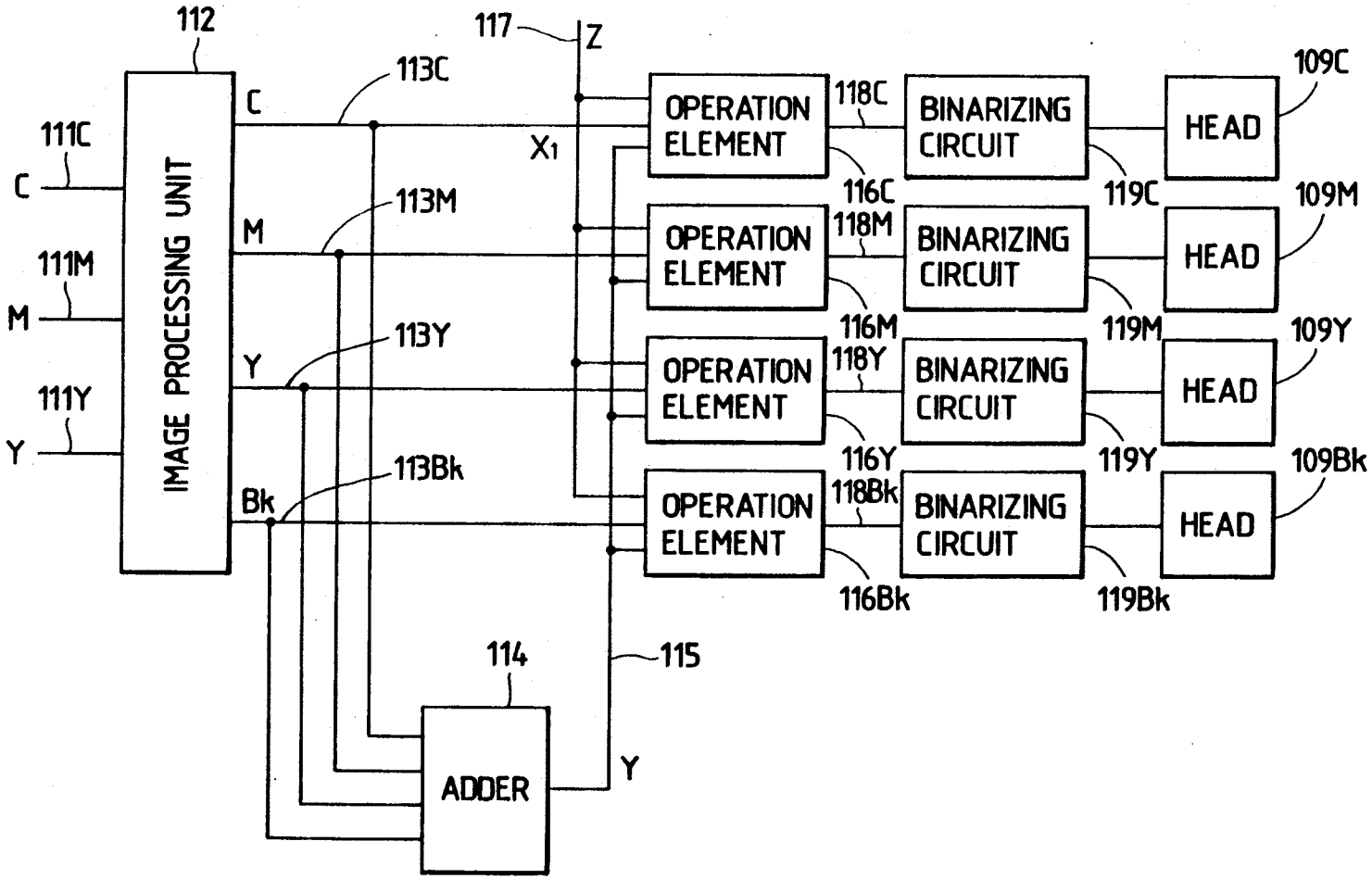
FIG. 9 is a block diagram showing a control unit of an image recording apparatus according to a fifth embodiment of the present invention.

FIG. 9 is a block diagram showing a control unit according to a fifth embodiment of the present invention. The control unit includes an image processing unit 112 for performing UCR, painting, masking, gamma correction, and the like and outputting cyan, magenta, yellow, and black signals 113C, 113M, 113Y, and 113Bk, and an adder 114 for adding the cyan, magenta, yellow, and black signals 113C, 113M, 113Y, and 113Bk and outputting an addition signal 115.

The control unit also includes operation elements 116C, 116M, 116Y, and 116BK for respectively receiving the cyan signal 113C, the magenta signal 113M, the yellow signal 113Y, and the black signal 113Bk in addition to the addition output 115 and a control signal 117, for performing predetermined operations, and for outputting final output signals 118C, 118M, 118Y, and 118Bk. The signals 118C, 118M, 118Y, and 118Bk are respectively binarized by binarizing circuits 119C, 119M, 119Y, and 119Bk using a dither method or an error diffusion method. The binarized signals are input to drive a cyan ink-jet head 109C, a magenta ink-jet head 109M, a yellow ink-jet head 109Y, and a black ink-jet head 109Bk, respectively. Each of the ink-jet heads 109C, 109M, 109Y, and 109Bk has 256 nozzles, and these heads are arranged, as shown in FIG. 1. The heads perform full-color image recording while performing serial scanning.

The function of the operation elements 116 will be described below. For example, if an output 118C from the operation element 116C is defined as F, it is given as follows:

$$F=f(X1, Y, Z)$$

where X1 is the cyan signal 113C, Y is the addition signal 115, and Z is the control signal 117.

The control signal Z is set to be "1" when the image signals supplied to the end nozzles, i.e., the first and 256th nozzles of the head, are processed. Otherwise, the signal Z is set at "0".

If Z=0, i.e., if an image signal is not an image signal supplied to an end nozzle of the head, the operation element 116C does not perform any operation to the cyan signal X1 and directly outputs it. Therefore, $$F(X1, Y, Z)=X1$$

for $Z=0$

If Z=1, i.e., if an angle is an image signal supplied to an end nozzle of the head, the operation element 116C outputs a value obtained by multiplying X1 with a coefficient a(y) which is changed in accordance with the value of the addition signal Y:

$$F(X1, Y, Z)=a(y)\times X1$$

for $Z=0$

The value of the coefficient a(y) is 1 at maximum and is gradually decreased when the value of y is increased.

Figure 10:
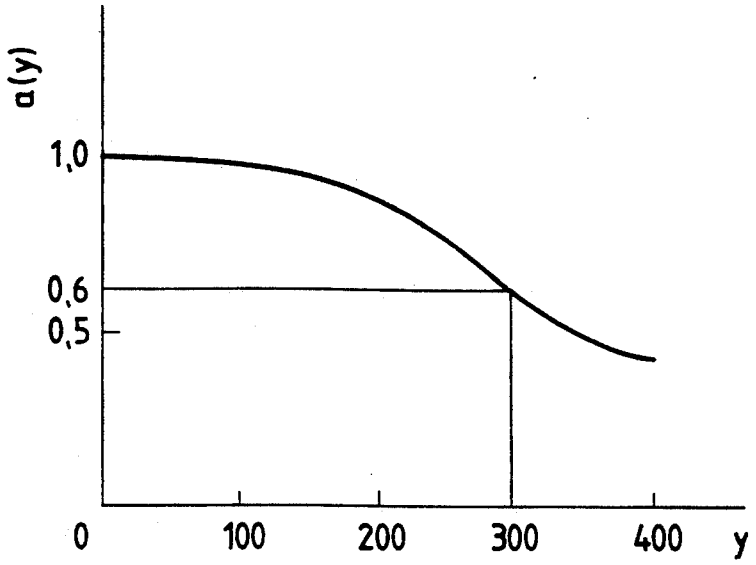
FIG. 10 is a graph for explaining a relationship between an addition signal and a correction coefficient in FIG. 9.

Referring to FIG. 10, the sum Y of each color signal which is obtained when the maximum value of each color signal is given as 100 is plotted along the abscissa, and the value of the coefficient a(y) is plotted along the ordinate. The value of the sum Y corresponds to a total ink amount and represents the range in which black stripes tend to be formed, i.e., the range in which the total recording ink amount is large. Therefore, the ink amount of the end nozzles is decreased to eliminate the black stripes.

Assume that the same coefficient a(y) as in FIG. 10 is used for the magenta, yellow, and black components. Even if the value of the sum Y is 300, i.e., when recording is performed using an ink amount corresponding to three-color solid printing, portions recorded by the end nozzles have a value of the sum Y of $0.6\times300=180$. That is, the portions recorded by the end nozzles are actually recorded with an ink amount smaller than that corresponding to two-color solid printing, thereby greatly eliminating black stripes.

When the total recording ink amount is small, almost no correction as described above is performed. Therefore, white stripes formed upon dot extraction at a low-density portion can also be prevented.

Sixth Embodiment

Figure 11:
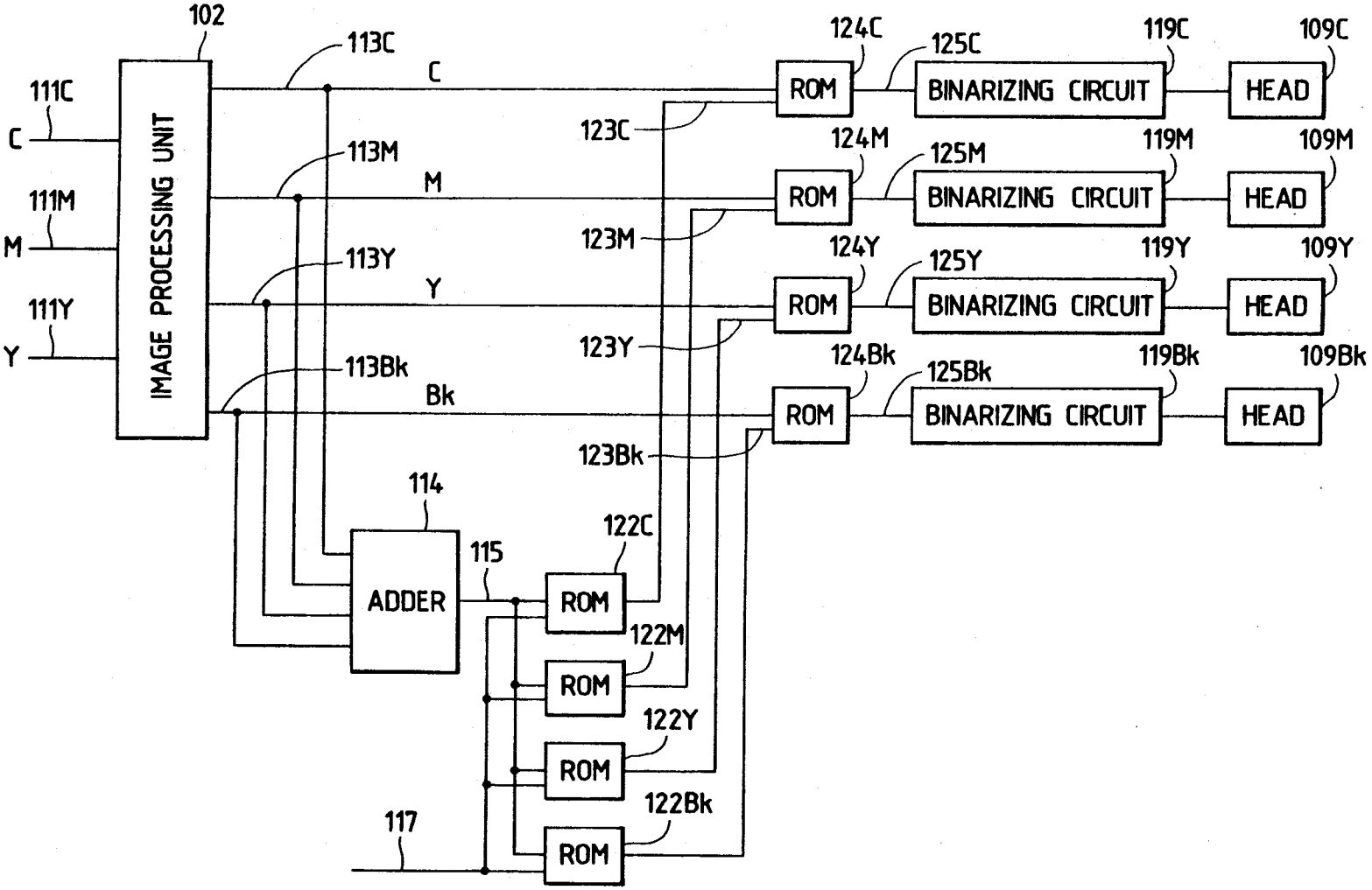
FIG. 11 is a block diagram of a control unit according to sixth and seventh embodiments of the present invention.

FIG. 11 is a block diagram showing a sixth embodiment of the present invention. The same reference numerals as in FIG. 9 denote the same parts in FIG. 11.

Cyan, magenta, yellow, and black signals 113C, 113M, 113Y, and 113Bk output from an image processing unit 112 are added by an adder 114. An addition signal 115 and a control signal 117 are input to gamma correction amount selection ROMs (to be referred to as gamma selection ROMs hereinafter) 122C, 122M, 122Y, and 122Bk. The gamma selection ROMs 122C, 122M, 122Y, and 122Bk output, e.g., 8-bit gamma selection signals 123C, 123M, 123Y, and 123Bk in accordance with the addition signal 115 and the control signal 117.

Figure 12:
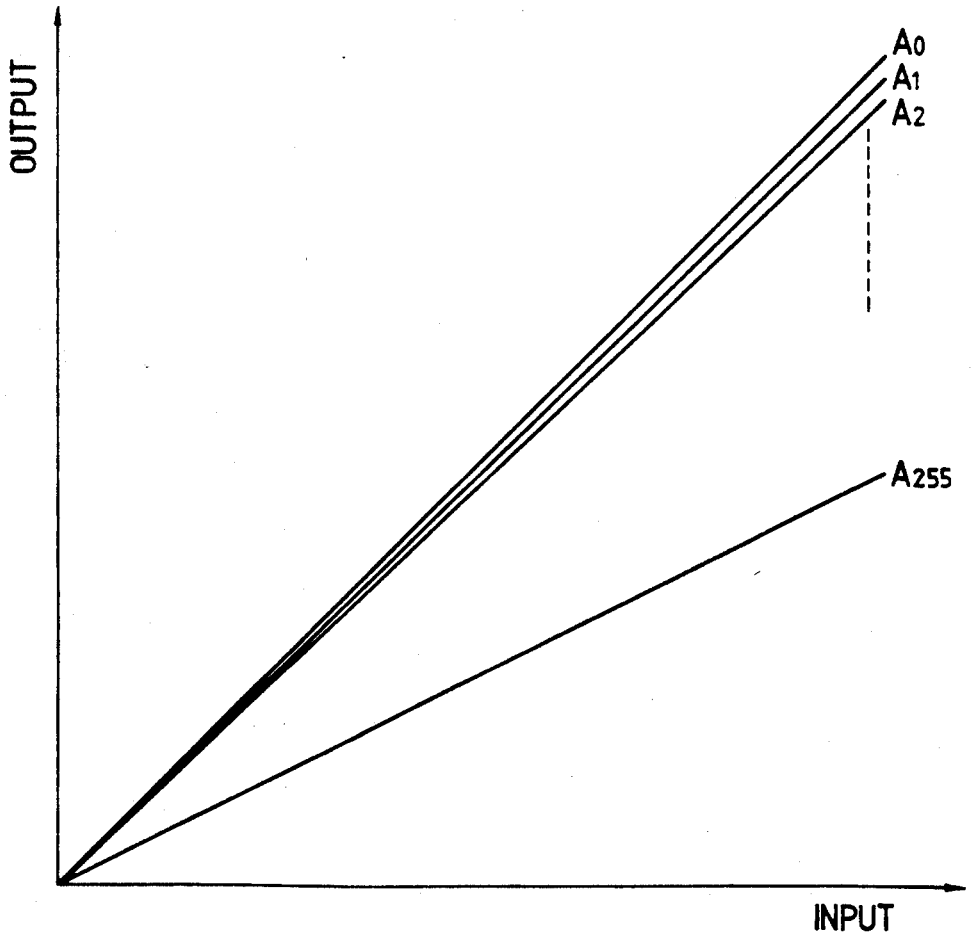
FIG. 12 is a graph for explaining a gamma conversion table of the sixth embodiment.

Gamma conversion ROMs 124C, 124M, 124Y, and 124Bk perform gamma conversion of the image signals 113C, 113M, 113Y, and 113Bk. Gamma correction tables from A0 to A255 are stored in each of the gamma conversion ROMs 124C, 124M, 124Y, and 124Bk, as shown in FIG. 12. If an input and an output are respectively defined as X and Y, A0 to A255 are defined as follows:

$$A0: Y = X$$
$$A1: Y = 0.998X$$
$$A2: Y = 0.996X$$
$$\vdots$$
$$An; Y = (1 - 0.002 \times n)X$$
for $n = 0$ to 255

A gamma conversion table to be used is A0 when the gamma selection signal 123 (123C to 123Bk) is set to be "0"; and a table to be used is Al when the signal 123 is set to be "1".

When the control signal 117 is set to be "0", i.e., when a pixel is not an end pixel, each gamma selection ROM always outputs "0". When the control signal 117 is set to be "1", each gamma selection ROM outputs the corresponding gamma selection signal in accordance with the addition signal 115.

Figure 13:
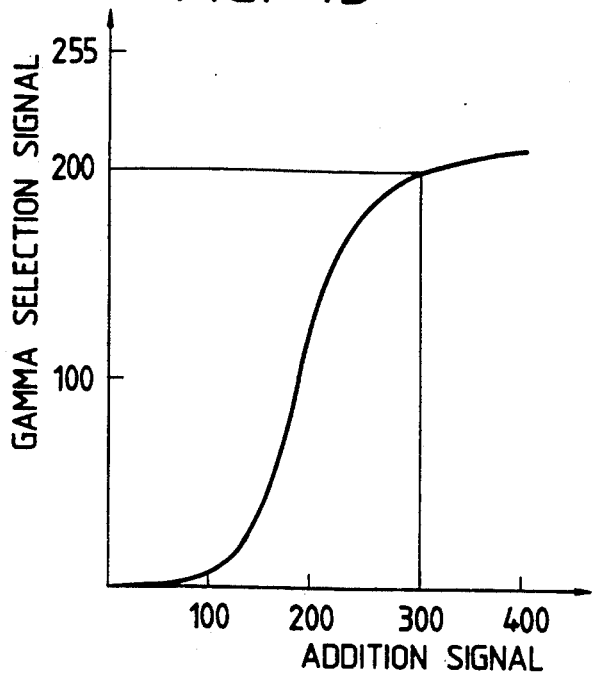
FIG. 13 is a graph for explaining a relationship between the addition signal and a gamma selection signal.

FIG. 13 shows a relationship between the addition signal and the gamma selection signal. When the addition signal is increased, the value of the gamma selection signal is increased, so that a correction ratio of the image signal is increased. For example, all the ROMS 122C, 122M, 122Y, and 122Bk have the relationship shown in FIG. 13. Since the ROMs 124C, 124M, 124Y, and 124Bk satisfy the relationship shown in FIG. 12, the image signal for the end pixel is given as $180=300\times(1-200\times0.002)$ even if the addition signal represents "300", i.e., the case corresponding to three-color solid printing.

Corrected image signals 125C, 125M, 125Y, and 25Bk are binarized by binarizing circuits 119C, 119M, 19Y, and 119Bk. The binarized signals are respectively input to cyan, magenta, yellow, and black heads 109C, 109M, 109Y, and 109Bk. These heads are then driven to perform color image recording. As a result, the amount of ink used by the end nozzles of the head is reduced, and black stripes can be greatly reduced. As is apparent from FIG. 13, since the correction amount is set to be small when a total ink amount is small, white stripes caused by dot extraction in a low-density portion can also be eliminated.

Seventh Embodiment

The same circuit arrangement (FIG. 11) as the sixth embodiment is employed in a seventh embodiment of the present invention, and gamma conversion tables stored in gamma conversion ROMS 124C, 124M, 124Y, and 24Bk are nonlinear.

Figure 14:
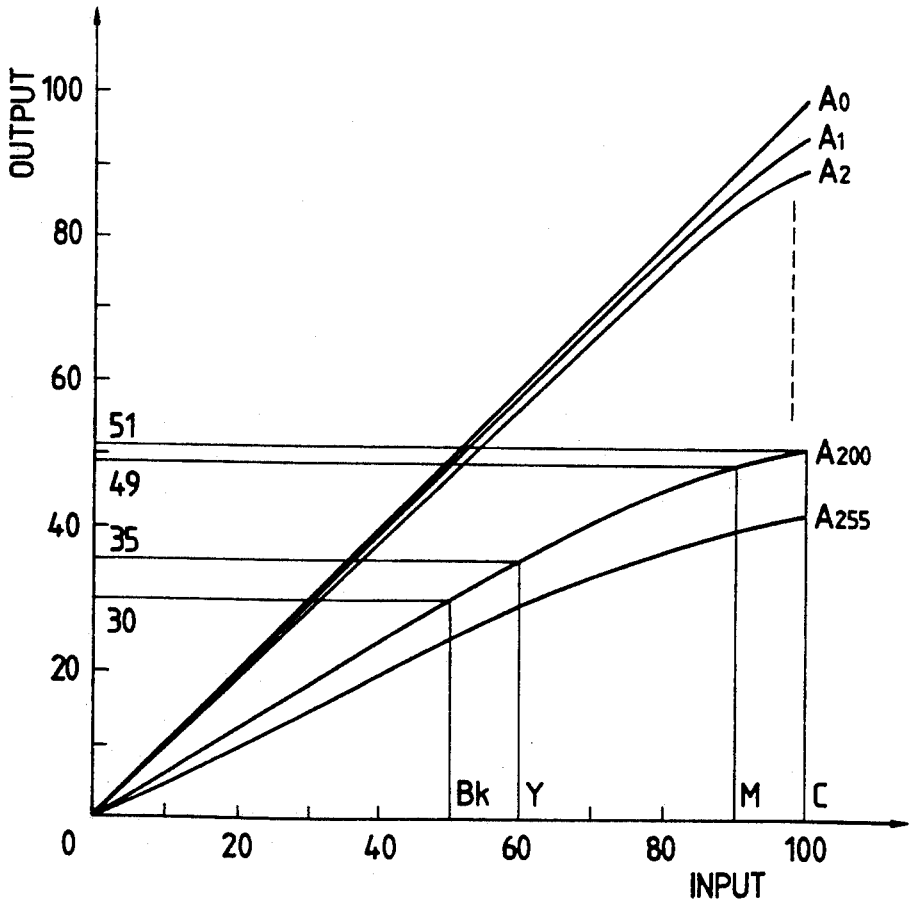
FIG. 14 is a graph showing a gamma conversion table of the seventh embodiment of the present invention.

For example, when a gamma conversion table shown in FIG. 14 is used, small correction of the noncorrected gamma table A0 is performed for a low-density portion, while large correction is performed for a high-density portion. Assume that the sum of the respective color signals represents "300", and that A200 is selected as the gamma conversion table. Under these assumptions, if C=100, M=90, Y=60, and Bk=50, then the components are converted into C=51, M=49, Y=35, and Bk=30, respectively.

In ink-jet recording, the density is generally saturated in a high-density portion. Even if the ink amount is slightly reduced, a change in density is small. Even if the signal correction amount is larger than that for a low-density portion, the density in a corrected portion is reduced to form white stripes or the density is changed to emphasize stripes. Therefore, according to this embodiment, the gamma conversion tables are nonlinear to increase the correction amount in a high-density portion. Therefore, the black stripes can be effectively prevented.

Figure 15:
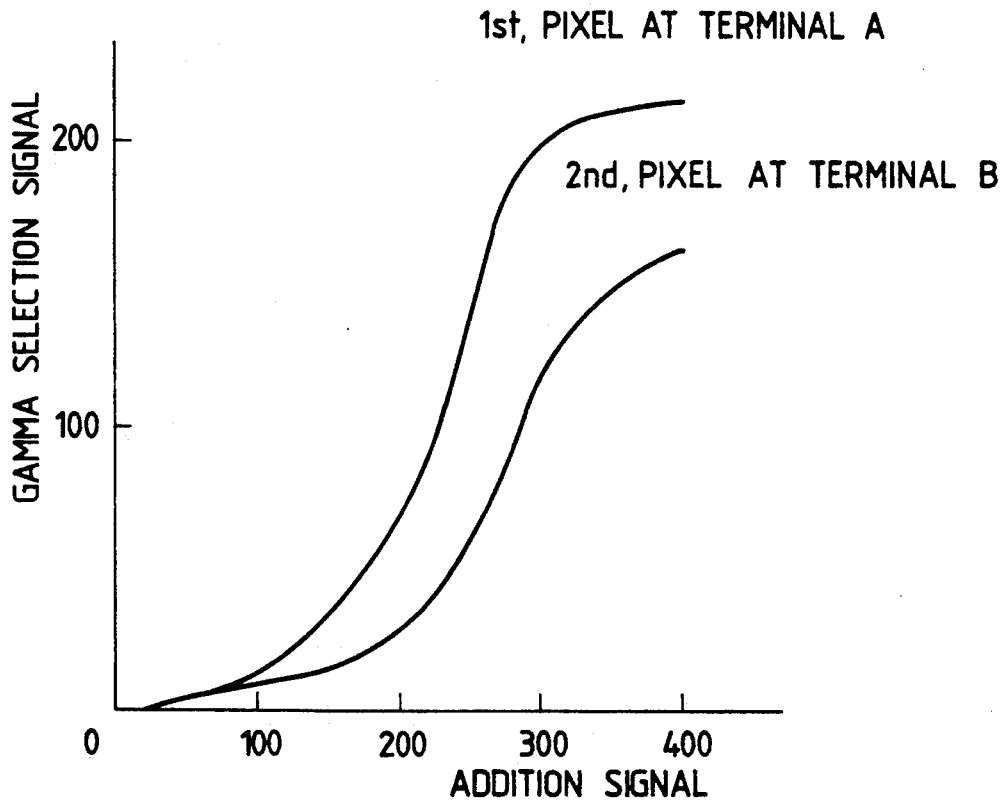
FIG. 15 is a view showing a relationship between an addition signal and a correction coefficient according to an eighth embodiment of the present invention.

In the fifth to seventh embodiments, the number of pixels to be corrected is not limited to one end pixel, but may be two or more. In this case, the end pixels need not be equally corrected. For example, a relationship between the addition signal (second embodiment) and the gamma selection signals as in an eighth embodiment shown in FIG. 15 may be employed. That is, as shown in FIG. 15, a relationship A is employed for the first pixel from the end portion, and a relationship B is employed for the second pixel from the end portion.

When correction is performed for a plurality of end pixels, the black stripes can be effectively prevented. The correction amounts are increased when the head position comes close to its end, thereby performing natural correction.

In each of the above embodiments, the ink-jet recording apparatus is exemplified. However, the present invention is applicable to a thermal transfer printer or a sublimable thermal transfer printer. In any case, the present invention is effectively and easily applicable to a recording apparatus which poses a boundary problem caused by serial scan.

The recording apparatus is not limited to the one requiring binarization. The present invention is also applicable to gradational recording upon modulation of the dot diameter to multivalues.

Furthermore, the present invention is not limited to the color image recording apparatus but is effectively applicable to an apparatus for performing gradational recording with a single color. In this case, for example, the ink-jet recording apparatus may have a plurality of recording heads having different ink injection amounts. Alternatively, a single recording head is used to perform gradational recording upon differentiating drive conditions (e.g., drive pulses).

The present invention may be used in back print mode wherein a reflected image is formed at a back surface of a back print paper (a resin paper having an ink absorbing layer at a back side thereof), and orthoscopic image is visible from a front surface of the resin paper, and only in a photographic mode wherein an enhancement of image quality is necessary. Further, the present invention is effective in high density mode wherein high density image on an origin of which density is detected manually or automatically is read in a manner of copier, and the image is recorded by the ink jet, and particularly in a mode wherein, on controlling the information quantity according to an error diffusion method, the process of the present invention is carried out. The above embodiment is most preferable as an example of using not only black color head but also another head. To take measure to a erroneous black stripe printing, the present invention is effectively used in controlling only the black color head.

The present invention provides excellent performance particularly in a recording head and recording apparatus using a bubble jet mode among the ink jet recording apparatus.

As a typical structure and principle, usage of an essential principle as shown in U.S. Pat. Nos. 4,723,129 and 4,740,796 is preferable. This bubble jet is usable both in an on demand type and continuous type apparatus. In particular, it is effective in a case of the on demand type one, since the electro-thermal converter arranged to correspond to a sheet and liquid path containing a liquid (ink) is provided with at least a drive signal for increasing temperature speedly to nucleate boiling corresponding to the recording so that the electro-thermal converter produces the thermal energy to produce film boiling at a heating surface of the recording head. Thereby the bubbles corresponding to the drive signals one are formed. The expansion and contraction of the bubble causes the liquid (ink) emission via the emission orifice to form at least one liquid droplet. When the drive signal is a pulse, since the bubble expansion and contraction can be achieved immediately, excellent response liquid (ink) emission can be desirably achieved. As such a pulse drive signal, those as shown in U.S. Pat. Nos. 4,463,359 and 4,345,262 are desirable. Further, in case of using the technique concerned with increasing temperature ratio at one heating surface as shown in U.S. Pat. No. 4,313,124, more preferable recording can be provided.

As a construction of the recording head, or a combination of the orifice, the liquid path and electro-thermal converter straight liquid path or right angle liquid path, as disclosed in the above documents and also a structure wherein heating unit is arranged in a bending region as disclosed in U.S. Pat. Nos. 4,558,333 and 4,459,600 is within the scope of the present invention. Further, the present invention is effective in a structure as disclosed in Japanese Patent Laid-open No. 59-138461 wherein a slit common to a plurality of electro-thermal converters is an orifice of the electro-thermal converters and a structure as disclosed in Japanese Patent Laid-open No. 59-138461 wherein an opening for absorbing a thermal energy pressure wave corresponds to the orifice.

Further, as a recording head of a full line type having a length corresponding to a maximum width to be recorded on the recording medium, a structure wherein the length thereof is filled with a combination of a plurality of recording heads, or a structure of integrally formed can be used in the present invention. An exchangeable recording head having an electrical connection to an apparatus body and an ink supply path from the body completed by mounting the head to the body, or a cartridge type recording head formed integrally with the body can be used in the present invention effectively.

It is desirable to additionally provide the recording head with a recovering means and preliminary auxiliary means since the performance of the present invention can be stabilized. Concrete examples of them are capping means an the recording head, cleaning means, pressure and absorbing means, and preliminary heating means comprising electro-thermal converter and separately formed heating elementary combination of the converter and the element. It is effective in stabilizing the recording to conduct a preliminary emission mode for preliminary emission different from the recording. The recording mode of the recording apparatus includes not only a recording mode of major color such as black, but also a complex color mode comprising different colors or a full color mode by mixing colors using integrally formed recording head or a combination of a plurality of recording heads.

Since, in case of using a regular paper, greater blotting is formed, it is preferable to automatically use the present invention for the regular paper according to a presetting.

In any cases, according to the present invention, sum of the image data is calculated. Only when the sum is greater than the data value at which the blotting is greater is the data is subtracted by a predetermined correction means of the apparatus body preferably in accordance with subtracting equation like the gamma curve (FIGS. 13 and 15) to produce a recording data for actual recording. Accordingly, high quality recording without erroneous black and white stripe can be achieved.

According to the above embodiments as has been described above, the image data applied to the end nozzles of each head are corrected in accordance with the sum of image signals recorded by the head end nozzles, thereby performing image recording free from black stripes in a high-density portion.

We claim:

1. An image recording apparatus for performing recording with a recording head in response to a recording signal by making ink droplets adhere to a recording medium to form dots thereon, the recording medium having a blot ratio determined by dividing the diameter of a dot on the recording medium by the diameter of the droplet that formed the dot, the apparatus comprising:

recording medium having a blot ratio;

scanning means for moving said recording head relative to the recording medium so that said recording head scans an area of the recording medium having a boundary, an end of said recording head corresponding to the boundary of the area;

means for generating image data;

discriminating means for discriminating image data to be supplied to the end of said recording head corresponding to the boundary of the area of the recording medium scanned by said recording head, wherein said discrimination means compares a reference value determined according to the blot ratio of the recording medium with the image data; and drive means for providing said recording head with a recording signal according to the image data, said drive means having a correction circuit for reducing the recording signal to be supplied to the end of said recording head when the discrimination means indicated that the image data is greater than the reference value.

2. An image recording apparatus according to claim 1, wherein said drive circuit does not use said correction circuit and supplies a recording signal equal to the image signal when the image data is smaller than the reference value.

3. An image recording apparatus according to claim 1, wherein said correction sets the recording signal at a constant value to be supplied to the end of said recording head.

4. An image recording apparatus according to claim 1, wherein said recording head has a plurality of color recording elements for producing an image by superposing inks of a plurality of different colors, and the image data is a total sum of the data for the color inks to be supplied to the end of said recording head.

5. An image recording apparatus according to claim 1, wherein the image data is a total sum of pixels in a matrix.

6. An image recording apparatus according to claim 5, wherein one of the pixels in the matrix is weighted.

7. An image recording apparatus according to claim 1, wherein the ink droplets are emitted using film boiling caused by thermal energy provided by said recording head.

8. An image recording apparatus according to claim 1, wherein said recording head includes at least one droplet-ejecting orifice at the end of said head and said correction circuit reduces only the recording signal to be supplied for said orifice.

9. An image data correction and recording method for use in an image recording apparatus for performing recording by making ink droplets adhere to a recording medium to form dots thereon, the recording medium having a blot ratio determined by dividing the diameter of a dot on the recording medium by the diameter of the droplet that formed the dot, the method comprising the steps of:

determining the blot ratio of the recording medium;

recording an image on the recording medium by relative movement of the recording medium and of recording means for forming droplets to be adhered to the recording medium, the relative movement causing the recording means to scan an area of the recording medium; and conducting a predetermined arithmetic operation on image data to be supplied to an end of the recording means corresponding to a boundary of the area of the recording medium scanned by the recording means, said arithmetic operation being performed according to the blot ratio of the recording medium, wherein said arithmetic operation reduces the image data when the image data is greater than a reference value determined according to the blot ratio, wherein the image on the boundary of the recording medium is recorded using the reduced image data based on the result of the arithmetic operation.

10. A method according to claim 9, wherein said arithmetic operation includes a correction parameter that is changed according to a change of the recording medium.

11. A method according to claim 9, wherein the blot ratio of the recording medium is obtained by an automatic discrimination of the recording medium being used in the image recording apparatus, and said arithmetic operation is changed according to the obtained blot ratio.

12. A method according to claim 9, wherein said arithmetic operation increases the reduction when recording an area approximate to the recording boundary.

13. A method according to claim 9, wherein said arithmetic operation is conducted on the basis of a gamma non-linear curve.

14. A method according to claim 9, wherein said image data is a total sum of pixels in a matrix.

15. A method according to claim 9, wherein the ink droplets are emitted using film boiling caused by thermal energy provided by the recording means.

16. A method according to claim 9, wherein the recording means includes at least one droplet-ejecting orifice at the end of the recording means and said arithmetic operation reduces only the image data to be supplied for the orifice.

17. An image recording apparatus for performing recording on a recording medium, said apparatus comprising:

a recording head having a plurality of orifices for emitting ink, said orifices being disposed in a predetermined direction;

main scanning means for scanning said recording head in a main scanning direction relative to the recording medium so that a predetermined width of a recording area is formed on the recording medium, wherein the main scanning direction is different from the predetermined direction in which said orifices are disposed;

subsidiary scanning means for scanning said recording head in a subsidiary scanning direction transverse to the main scanning direction and relative to the recording medium;

conversion means for converting density data for causing ink to be emitted from at least an end orifice at an end of said recording head to converted density data, the converted density data resulting in a reduced quantity of ink being emitted from the end orifice; and drive means for driving said recording head based on the converted density data.

18. An apparatus according to claim 17, wherein said conversion means is a ROM for converting the density data for causing the ink to be emitted form the end orifice and outputting the same.

19. An apparatus according to claim 17, wherein said conversion means performs one density data conversion only when the density data is larger than a predetermined value.

20. An apparatus according to claim 17, wherein said drive means has a binarizing means for binarizing the converted density data.

21. An apparatus according to claim 17, wherein said recording head produces an ink state transition by means of thermal energy so as to emit the ink from the orifices.

22. An apparatus according to claim 17, wherein said recording head emits ink of a plurality of colors.

23. An image recording apparatus for recording on a recording medium, said apparatus comprising:

a recording head having a plurality of orifices for emitting ink, said orifices being disposed in a predetermined direction;

main scanning means for scanning said recording head in a main scanning direction relative to the recording medium so that a predetermined width of a recording area is formed on the recording medium, wherein the main scanning direction is different from the predetermined direction in which said orifices are disposed;

subsidiary scanning means for scanning said recording head in a subsidiary scanning direction transverse to the main scanning direction and relative to the recording medium;

arithmetic operation means for processing density data for causing ink to be emitted from a plurality of orifices defied at a peripheral edge of said recording head to produce arithmetic data which indicates a total sum of a quantity of the ink emitted from the peripheral edge of said recording head;

conversion means for converting density data corresponding to at least one end orifice at the periphery edge of said recording head based on the arithmetic data to converted density data, the converted density data resulting in are reduced quantity of ink emitted from the end orifice; and driving means for driving said recording head based on the conveyed density data.

24. An apparatus according to claim 23, wherein said arithmetic operation means performs a weighted arithmetic operation in processing the density data of ink emitted from the plurality of orifices.

25. An apparatus according to claim 24, wherein said recording head produces an ink state transition by means of thermal energy so as to emit the ink from the orifices.

26. An apparatus according to claim 24, wherein said recording head emits ink of a plurality of colors.

27. An apparatus according to claim 23, wherein said conversion means adjusts the quantity of ink emitted from the orifices based on the density data converted by said conversion means.

28. An apparatus according to claim 27, wherein said conversion means includes a switch for changing the quantity of the ink emitted from the orifices.

29. An apparatus according to claim 27, wherein said conversion means includes detection means for detecting a blot coefficient of the recording medium, and switches the quantity of ink emitted from the orifices based on the blot coefficient detected by said detection means.

30. An image recording apparatus for recording on a recording medium, said apparatus comprising:

recording heads for recording images on the recording medium, said recording heads having a plurality of orifices for emitting ink, with each of said head emitting ink of a different color, said orifices being disposed in a predetermined direction;

main scanning means for scanning said recording head in a main scanning direction relative to the recording medium so that a predetermined width of a recording area is formed on the recording medium, wherein the main scanning direction is different from the predetermined direction in which said orifices are disposed;

subsidiary scanning means for scanning said recording heads in a subsidiary scanning direction transverse to the main scanning direction and relative to the recording medium;

addition means for adding density data for causing ink to be emitted from an end orifice at each end of said plurality of recording heads to produce adding data which indicates a total sum of a quantity of the ink emitted from a peripheral edge of each recording head;

conversion means for converting density data corresponding to at least one end orifice at the peripheral edge of said recording head based on the adding data to converted density data, the converted density data resulting in a reduced quantity of ink being emitted from the end orifices; and drive means for driving said recording heads based on the converted density data.

31. An apparatus according to claim 30, wherein said plurality of recording heads emit cyan, magenta, yellow and black ink.

32. An apparatus according to claim 30, wherein said conversion means converts the density data of the ink emitted form said plurality of recording heads.

33. An apparatus according to claim 32, wherein said conversion means operates density data for ink emitted from one of said plurality of recording heads.

34. An apparatus according to claim 33, wherein said conversion means performs the density data conversion for said recording head emitting black ink.

35. An apparatus according to claim 30, wherein each recording head produces an ink state transition by means of thermal energy so as to emit the ink form said orifices.

36. An image recording apparatus for recording on a recording medium, said apparatus comprising:

a plurality of recording heads for recording images on the recording medium, said recording heads having a plurality of orifices for emitting ink, with each recording head imitating ink of a different color;

main scanning means for scanning said recording heads in a main scanning direction relative to the recording medium so that a predetermined width of a recording area is formed on the recording medium;

subsidiary scanning means for scanning said recording heads in a subsidiary scanning direction transverse to the main scanning direction and relative to the recording medium;

reading means for reading an original document;

discrimination means for discriminating density of the images on the original document read by said reading means;

conversion means for converting density data for causing ink to be emitted from at least an end orifice located at an end of said recording heads to converted sanity data, the converted density data resulting in a reduced quantity of ink being emitted from the end orifices; and driving means for driving said recording heads based on the converted density data.

37. An apparatus according to claim 36, wherein said conversion means performs the density conversion for said recording head emitting black ink.

38. An apparatus according to claim 36, wherein the recording medium is a back print film.

39. An apparatus according to claim 36, wherein said recording heads produce an ink state transition by means of thermal energy so as to emit the ink from the orifices.

* * * * *

UNITED STATES PATENT AND TRADEMARK OFFICE

CERTIFICATE OF CORRECTION

PATENT NO. : 5,225,849

DATED : July 6, 1993

INVENTOR(S) : Akio SUZUKI, et al.

It is certified that error appears in the above-indentified patent and that said Letters Patent is hereby corrected as shown below:

ON THE TITLE PAGE:

AT [56] REFERENCES CITED - U.S. PATENT DOCUMENTS:

"Kirjauainen" should read --Kirjavainen et al.--.

COLUMN 2:

Line 30, "d=Δd." should read --d+Δd.--;

Line 35, "d=Δd," should read --d+Δd,--.

COLUMN 3:

Line 41, "and" should read --and 4B are--.

COLUMN 5:

Line 31, "datas 64" should read --data S64--.

COLUMN 6:

Line 33, "ßis" should read --ß is--.

COLUMN 8:

Line 25, "Z=0" should read --Z=1--.

UNITED STATES PATENT AND TRADEMARK OFFICE

CERTIFICATE OF CORRECTION

PATENT NO. : 5,225,849

DATED : July 6, 1993

INVENTOR(S) : Akio SUZUKI, et al.

It is certified that error appears in the above-indentified patent and that said Letters Patent is hereby corrected as shown below:

COLUMN 9:

Line 41, "19Y," should read --119Y,--.

COLUMN 11:

Line 11, "speedly" should read --speedily--;

Line 15, "Thereby" should read --Thereby,--;

Line 16, "one" should be deleted;

Line 47, after "formed" --recording heads-- should be inserted;

Line 58, "an" should read --for--.

COLUMN 12:

Line 7, "cases," should read --case,--;

Line 10, "is" (second occurrence) should be deleted;

Line 60, "correction" should read --correction circuit--.

COLUMN 15:

Line 1, "are" should read --a--;

Line 4, "conveyed" should read --converted--;

UNITED STATES PATENT AND TRADEMARK OFFICE

CERTIFICATE OF CORRECTION

PATENT NO. : 5,225,849

DATED : July 6, 1993

INVENTOR(S) : Akio SUZUKI, et al.

It is certified that error appears in the above-indentified patent and that said Letters Patent is hereby corrected as shown below:

Line 9, "claim 24," should read --claim 23,--;

Line 14, "claim 24," should read --claim 23,--;

Line 38, "head" should read --heads--;

Line 56, "one" should read --the--; and "orifice" should read --orifices--.

COLUMN 16:

Line 12, "operates" should read --converts--;

Line 19, "form" should read --from--;

Line 26, "imitating" should read --emitting--;

Line 44, "sanity" should read --density--;

Line 47, "driving" should read --drive--.

Signed and Sealed this

Tenth Day of May, 1994

Bruce Lehman

*Attest:*

BRUCE LEHMAN

*Attesting Officer*

*Commissioner of Patents and Trademarks*